US006068880A

United States Patent [19]

Hills

[11] Patent Number: 6,068,880

[45] **Date of Patent: *May 30, 2000**

[54] METHOD AND APPARATUS FOR FORMING A GUIDE COAT

[75] Inventor: Robin William Hills, High Wycombe, United Kingdom

[73] Assignee: Speedarrive Projects Ltd., United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/619,468

[22] PCT Filed: Sep. 23, 1994

[86] PCT No.: PCT/GB94/02075

§ 371 Date: Mar. 22, 1996

§ 102(e) Date: Mar. 22, 1996

[87] PCT Pub. No.: WO95/08405

PCT Pub. Date: Mar. 30, 1995

[30] Foreign Application Priority Data

Sep. 24, 1993 [GB] United Kingdom ..... 9319789

[51] Int. Cl.[7] ..... B05D 5/00

[52] U.S. Cl. ..... 427/198; 427/180; 427/202; 427/277; 427/289; 427/429; 427/142

[58] Field of Search ..... 401/8, 200, 207, 401/89, 98, 140; 222/166, 196.4, 203, 637, 632, 633; 427/8, 11, 142, 198, 180, 197, 429, 202, 277, 289; 118/76, 308, 713

[56] References Cited

U.S. PATENT DOCUMENTS

| | | | |
|---|---|---|---|
| 2,317,662 | 4/1943 | Zimmerman . | |
| 2,365,921 | 12/1944 | Vaughn . | |
| 2,400,926 | 5/1946 | Harding . | |
| 2,919,703 | 1/1960 | Pintear . | |
| 3,682,558 | 8/1972 | Miller | 401/200 |
| 3,729,011 | 4/1973 | Gleicher | 132/83 |

(List continued on next page.)

FOREIGN PATENT DOCUMENTS

| | | |
|---|---|---|
| 0291284 | 11/1988 | European Pat. Off. . |
| 0492204 | 7/1992 | European Pat. Off. . |
| 1101727 | 10/1955 | France . |
| 2686810 | 8/1993 | France . |
| 3424712 | 2/1986 | Germany . |
| 3841986 | 4/1990 | Germany . |
| 2209968 | 6/1989 | United Kingdom . |
| 9530493 | 11/1995 | WIPO . |

OTHER PUBLICATIONS

"Notification of Transmittal of the International Search Report or the Declaration", International Searching Authority, Form PCT/ISA/210, 4 pp., Jan. 31, 1995.

"Written Opinion", International Preliminary Examining Authority, Form PCT/IPEA/408, 7 pp., Jun. 29, 1995.

Correspondence from Oxford Patent Attorney to European Patent Office, 5 pp., Jan. 18, 1996.

"Notification of Transmittal of International Preliminary Examination Report", International Preliminary Examining Authority, Form PCT/IPEA/416, 9 pp., Jan. 25, 1996.

*Primary Examiner*—Fred J. Parker

*Attorney, Agent, or Firm*—Webb Ziesenheim Logsdon Orkin & Hanson, P.C.

[57] ABSTRACT

A guide coat is formed on a surface as part of a smoothing operation, e.g., during vehicle bodywork, by distributing finely divided particulate material, e.g., a non-toxic, water-based black powder paint, over the surface so the material remains on and thus highlights any irregularities on the surface. The material may be wiped onto the surface by an applicator, e.g., synthetic foam or sponge, impregnated with the material. The material may be stored in a container in a loose, finely divided form or in a compact, substantially solid form from which finely divided particles may be removed. The majority of the material is subsequently removed from the surface as the surface is abraded to remove the highlighted irregularities.

22 Claims, 5 Drawing Sheets

U.S. PATENT DOCUMENTS

| | | | |
|---|---|---|---|
| 3,953,643 | 4/1976 | Cheung | 428/220 |
| 4,176,205 | 11/1979 | Molina | 427/1 |
| 4,226,740 | 10/1980 | Worsham et al. | 252/408 |
| 4,269,527 | 5/1981 | Lipfert et al. | 401/200 |
| 4,356,941 | 11/1982 | McRoskey et al. | 222/632 |
| 4,393,112 | 7/1983 | Honjo et al. | 428/207 |
| 4,728,210 | 3/1988 | Barish et al. | 401/6 |
| 4,752,147 | 6/1988 | Persi . | |
| 5,721,011 | 2/1998 | Bastow . | |

METHOD AND APPARATUS FOR FORMING A GUIDE COAT

TECHNICAL FIELD

This invention relates to a method and apparatus for forming a guide coat on a surface, eg the surface of a vehicle body which is being repaired and refinished.

BACKGROUND ART

When a surface such as that of a vehicle body is being refinished, particularly after repair of accident damage, it is common practice to apply body fillers and stoppers (a very fine filler) and a series of layers of primers, stone chip or corrosion protection coatings, paint coats and sealants etc which are each rubbed down before application of the next coat in order to obtain a smooth surface and to assist in re-working of top paint coats and lacquers. Filling materials are used to repair indentations, scratches etc and these are prepared by sanding, filing and other abrasive techniques to achieve a smooth surface. This may be done using power assisted equipment or by hand. A range of abrasive materials may be used such as sand papers, production papers, wet and dry abrasive papers and sanding pads. Coarse abrasives are initially used then finer and finer abrasives until the desired finish is achieved.

To assist in this process it is known to apply a guide coat to the surface being re-finished. The guide coat is an intermediate coat applied to one of the re-finishing coats to provide a visual guide to the progress of such smoothing operations. As the surface of a coating of, say, primer is eroded by sanding, the guide coat is removed from the high spots of that coating whereas the guide coat remains on low spots or other indentations. The operator may continue the abrading process to smooth out these irregularities and thus remove the guide coat or it may prove necessary to correct surface irregularities revealed by further filling or re-working the surface (eg by panel beating) before the sanding process is continued. The guide coat thus helps the operator to achieve a smooth finish by visually enhancing any irregularities remaining in the surface during sanding and by indicating the areas which have not yet been sanded. Such a guide coat may be used at each stage of the process, ie for each coating which requires rubbing down, or as required by the operator. A guide coat may also be applied to highlight particular surface irregularities or blemishes such as scratches, pin holes, 'orange peel' or dry spray edges.

The guide coat is conventionally formed by a dilute mixture of paint and thinners, eg 1 part paint to 10 parts thinners, sprayed over the surface being refinished. However, this suffers from the disadvantages that surrounding areas need to be masked, as the thinners based coating may stain or otherwise damage good paintwork, and as the thinners is usually a volatile petrochemical, such as a cellulose solvent, the operator should wear a mask and fume extraction is required for the area in which the work is carried out. With increasing legislation designed to protect the environment, severe restrictions are likely to be imposed on such fume extraction and the use of such solvent based guide coats may no longer be permitted. In addition, there are the usual problems associated with the storage of such flammable liquids.

This invention aims to provide a simple, convenient method and apparatus which enable a guide coat to be formed without the need to use such petrochemical solvents and so avoids the disadvantages of these materials.

DISCLOSURE OF INVENTION

According to a first aspect of the invention, there is provided a method of forming a guide coat on a surface as part of a smoothing or re-finishing operation, the method comprising the step of distributing finely divided, particulate material over the surface so that the material remains on irregularities on the surface, the material being of contrasting colour to the surface to which it is applied.

According to a second aspect of the invention, there is provided guide coat forming apparatus comprising: material for forming a guide coat of finely divided, particulate material and applicator means for distributing the particulate material over a surface.

According to a further aspect of the invention, there is provided a method of smoothing or re-finishing a surface comprising the steps of: forming a guide coat on the surface by the method detailed above or using the apparatus detailed above to visually enhance irregularities on the surface and abrading and/or filling and/or reworking the surface irregularities thus highlighted.

Other features of the invention will become apparent from the following description and from the subsidiary claims of the specification.

BRIEF DESCRIPTION OF DRAWINGS

The invention will now be further described, merely by way of example, with reference to the accompanying drawings in which.

BEST MODE OF CARRYING OUT THE INVENTION

Figure 1:
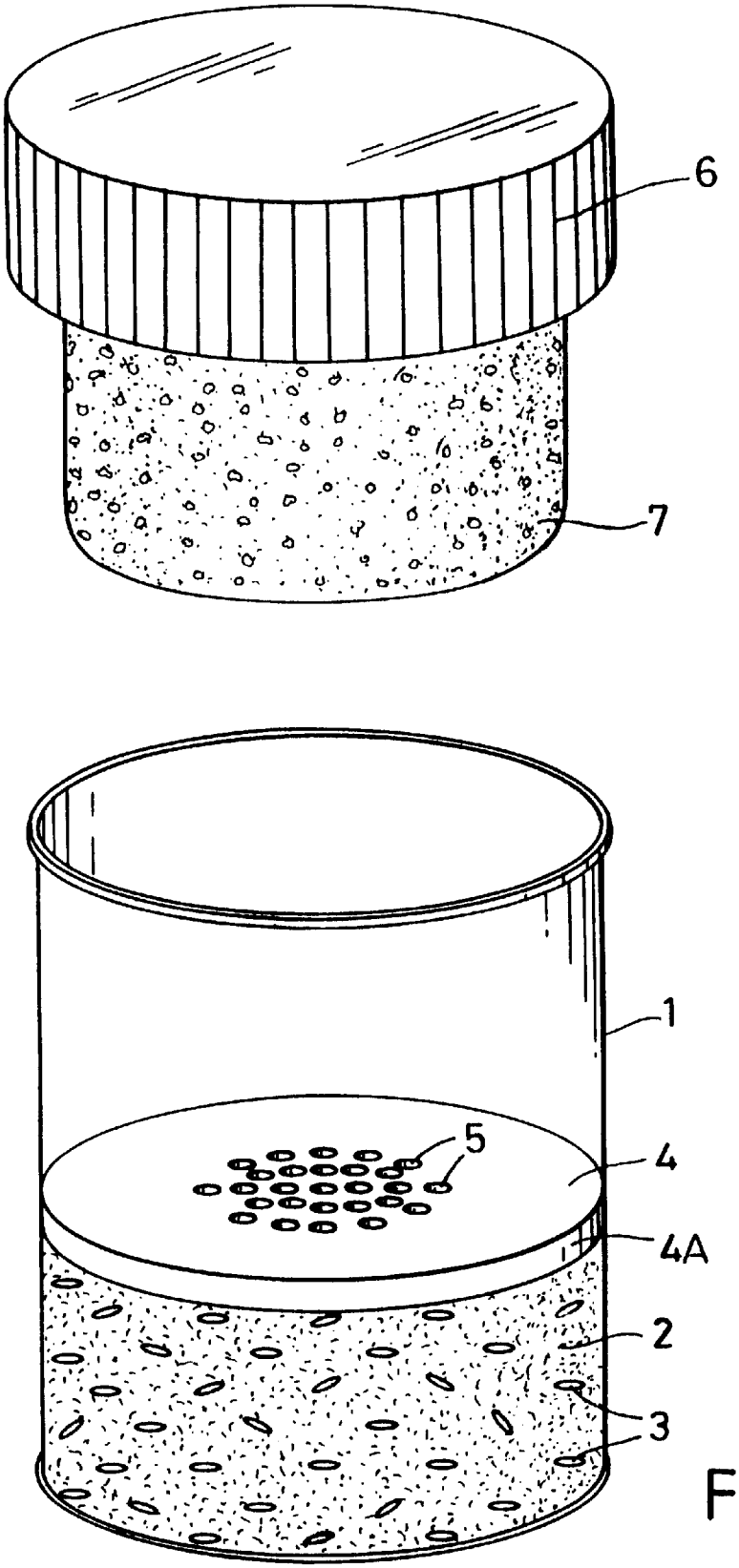
FIG. 1 is a perspective view of a first embodiment of apparatus according to the invention.

FIG. 1 shows apparatus comprising a container in the form of a plastics or metal can 1 of a size suitable for holding in the hand, eg around 10 cm in diameter and 15 cm tall. A dry powder 2, eg a black, non-toxic, water-based powder paint, is held in the container 1 and a drying agent, for instance rice 3, is preferably nixed with powder 2 to help keep it dry. A separator 4 in the form of a perforated plastics of metal plate with a flange 4A is preferably fitted in the container 1 above the powder 2. The perforations 5 in the plate 4 are large enough to allow the powder to pass therethrough but small enough to prevent the passage of the drying agent 3 through the separator 4. The perforations would typically have dimensions of around 1–2 mm. The drying agent may also be contained in a sachet or other enclosure as well known in other fields.

The container 1 is provided with closure means in the form of a lid 6 which has applicator means in the form of a synthetic sponge 7 attached to the underside thereof. The applicator sponge 7 is sized so that it fits within the top of the container 1 when the lid 6 is fitted onto the container 1 and is also sized so that a space is left between the separator plate 4 and the bottom surface of the sponge 7 when the lid 6 is fitted to the container 1.

In use, the container is shaken or inverted with the lid 6 in place so that powdered paint 2 passes through the separator plate 4 onto the sponge 7. The lid 6 can then be removed and held in the hand to apply the powdered paint adhering to or impregnated in the sponge 7 the surface on which the guide coat is to be formed. The powder is then distributed over the surface by simply wiping the sponge 7 over the surface to leave a thin coating of dry powder thereon which acts as a guide coat in a similar manner to the conventional form of guide coat described above.

It has been found that the powder remains on relatively rough surfaces such as those of a car body panel being rubbed down (even when it has been rubbed down by a very fine abrasive sheet, eg P1200 paper) even whilst the surface is vertical or downward facing but does not remain on or can easily be wiped or blown off a relatively smooth surface such as that of the gloss paint on a car body panel. The powder is removed by subsequent rubbing down techniques, using abrasive blocks, wet and dry sand paper, etc as described above. The majority of the powder is removed in this way but it has been found that any small amounts of powder remaining after rubbing down can be left in place and is not detrimental to the application of further filler, primers, etc. Any powder falling on surrounding paintwork can be simply wiped off with a clean rag, brushed or blown off or removed by washing the surface with water or other suitable solvent.

A separator plate 4 is preferably provided in the container 1 to help control the quantity of powder applied to the sponge 7 when the container 1 is shaken or inverted. It will also be appreciated that a space is required between the separator plate 4 and the sponge 7 to allow powder to be distributed over the sponge 7. If the sponge 7 were pressed against the plate 4, only a very limited amount of powder would be able to pass through the perforations 5 to the sponge 7. However, it is possible to omit the separator plate (see FIG. 2 described below) and if excess powder falls onto the sponge 7 this can be shaken off before the sponge 7 is used to apply powder to a surface.

The separator plate 4 is preferably held in position by means of its flange 4A which is a friction fit within the container 1 so the plate 4 does not move when the container is inverted or shaken. However, if a force is applied directly to the plate 4 it can be slid up or down the container 1 so that its height can be adjusted as required.

When the container 1 is charged with powder 2, sticky tape or a sticky label or some other form of seal (not shown) may be provided over the perforations 5 to prevent powder passing through the separator plate 4 when the product is being transported or handled before use. The seal then removed before the apparatus is first used.

The sponge 7 preferably comprises a compressible medium density synthetic foam material which is capable of absorbing sufficient powder but which is sufficiently firm to enable the powder to be applied to a surface by wiping the sponge 7 over the surface. One form of material which has been found to be suitable is a foam sponge supplied by Motofax Ltd under the designation Foam Mator Ester 280 Blue. The sponge 7 would typically have a diameter of around 8 cm and project around 4 cm from the lid 6. The sponge 7 may be simply affixed to the lid 6 by means of an adhesive.

Other forms of applicator means may be used, eg a synthetic foam, an absorbent cloth or wad of material (such as natural or man-made lambswool) or a soft brush, the main requirement being that the applicator means is capable of absorbing or becoming impregnated with a sufficient quantity of powder which can then be distributed over a surface by wiping the applicator means over the surface (see other embodiments described below).

The lid 6 is preferably provided with ribs or other gripping means around its periphery so that it can be held comfortably in the hand when the sponge 7 is used to apply the powder to a surface. Alternatively, or additionally, the lid may be provided with a strap or band which in use passes around the back of the operator's hand and helps hold the lid and applicator in place in the operator's hand (see FIGS. 4 and 6 described below). In another arrangement, a handle, eg in the form of a paint brush handle, may be attached to the applicator (see FIG. 3 described below).

As mentioned above, the lid 6 and sponge 7 may be separate parts which are secured together. It would also be possible for the applicator means and the closure means to be formed by one item, eg by a relatively firm sponge which is shaped to be a push fit within the open end of the container 1 and thus act as closure means (see FIG. 2 described below).

In another arrangement, the closure means and applicator means may be separate items, for example the closure means may comprise a simple lid and the applicator means comprise a separate sponge which can be stored outside the container or, preferably, within the container.

Any finely divided particulate material or medium may be used to form the guide coat as long as it can be easily distributed over the surface to be smoothed and has the tendancy to remain on and thus highlight irregularities on the surface. A powder such as a non-toxic, water soluble black powder paint obtained from the Early Learning Centre (South Marston, Swindon SN3 4TJ, UK) has been found to be suitable. The particulate material may be of any appropriate colour depending on the application. A black guide coat is usually used in the repair of car body panels as this shows up well on light coloured filler materials and on grey primers and undercoats. The material used should preferably be non-staining to paint finishes such as those used on vehicle bodywork. Powder paints for use by children have to meet stricter health and safety requirements and are thus believed to be made of natural or inert materials which are unlikely to cause harm in ingested. Materials used in such paints include dried albumen and chalk. Black paints include carbon black and other colours are obtained by the use of natural colouring agents as used in the food industry.

The lid 6 is preferably a tight press-fit onto the container 1 so as to prevent leakage of powder when the lid 6 is in place. Alternatively, a screw-fitting or snap-fit lid may be used.

Figure 2:
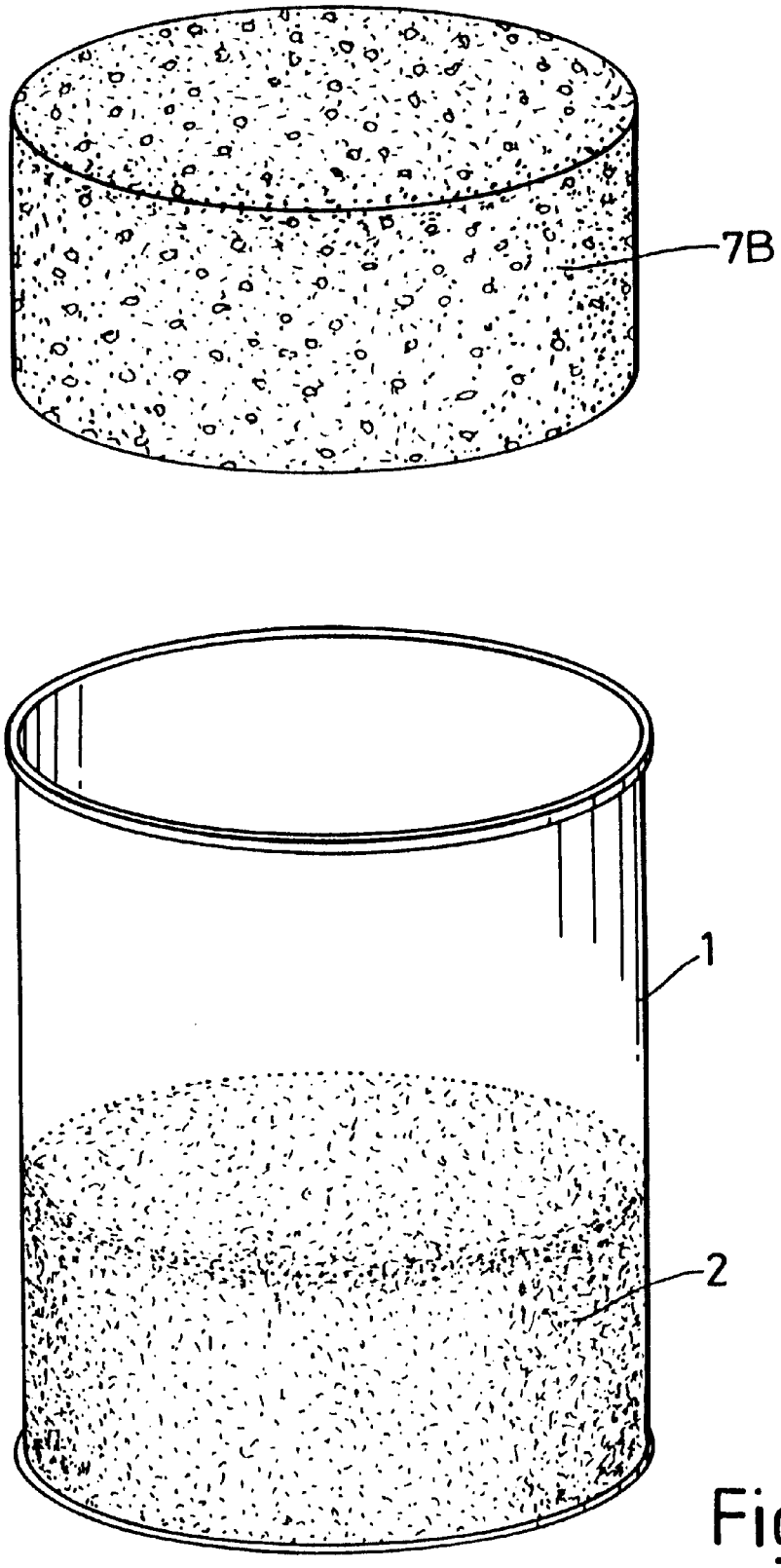
FIG. 2 is a perspective view of a second embodiment of apparatus according to the invention.

FIG. 2 illustrates apparatus similar to that shown in FIG. 1 although in this case, the separator plate 4 is omitted and the applicator means 7B is in the form of a sponge which is shaped and sized so as to be a push fit in the open end of the container 1. The applicator means 7B thus also acts as the closure means in this embodiment.

Figure 3:
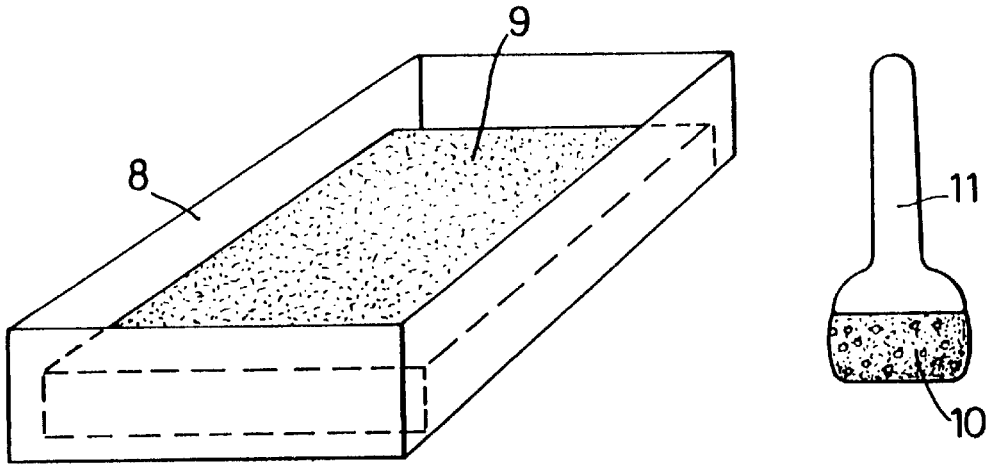
FIG. 3 is a perspective view of a third embodiment of apparatus according to the invention.

FIG. 3 illustrates another form of the apparatus. In this case, a rectangular, box-like container 8 with an open top is used. Guide coat forming material 9 is provided in the container 8 as a compact, substantially solid block of material. This block of material 9 is such that material in a finely divided, particulate form can be removed from the surface of the block, eg by rubbing applicator means over the surface thereof. The block may, typically, be formed of a powder paint similar to that used in the embodiment described in relation to FIGS. 1 and 2 but which has been compacted into a substantially solid form. The block 9 preferably has a length slightly shorter than that of the container 8 to facilitate access to the ends of block 9.

A variety of different forms of applicator means may be used to remove powder from the surface of the block 9 and one example is shown in FIG. 3. This comprises a piece of sponge 10 similar to that described above attached to a handle 11 in the form of a paint brush. By simply rubbing the sponge 10 over the surface of the block 9, powder is removed from the surface of the block and becomes impregnated in the sponge 10. The sponge 10 can then be wiped over a surface on which a guide coat is to be formed.

It would be equally possible to use a conventional brush with bristles rather than the sponge 10 so long as the block of material 9 is of a nature which enables the bristles to remove powder from the surface thereof when brushed over the surface.

Figure 4:
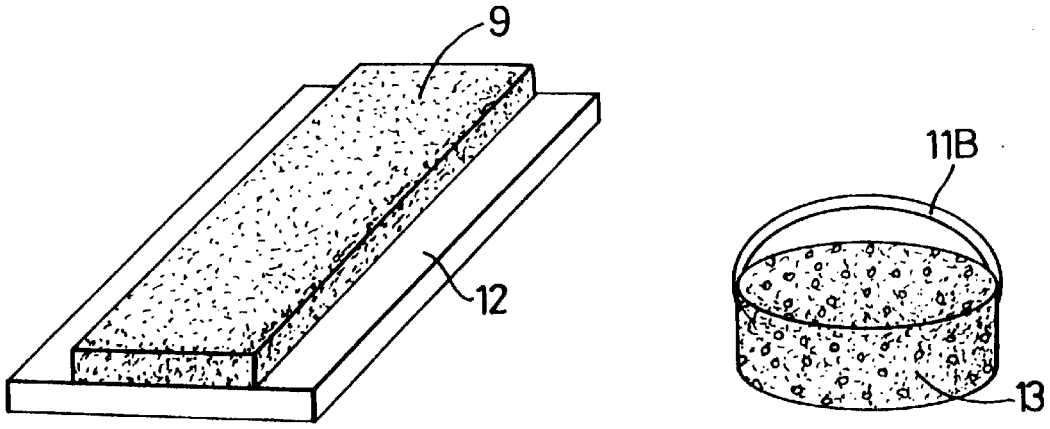
FIG. 4 is a perspective view of a fourth embodiment of apparatus according to the invention.

FIG. 4 illustrates another embodiment somewhat similar to that shown in FIG. 3. In this case, a substantially solid block of material 9 is secured to a simple plinth 12. FIG. 4 illustrates applicator means in the form of a circular sponge 13 with a strap 11B attached thereto for holding the applicator to the operator's hand. The sponge 13 can thus be held in a similar manner to a grooming brush.

As mentioned above, the block 8 may be a solid form of powder paint. One suitable type is that available from Woolworths and manufactured by C B Parsons Ltd of Ashby-de-la-Zouch, UK.

Figure 5A:
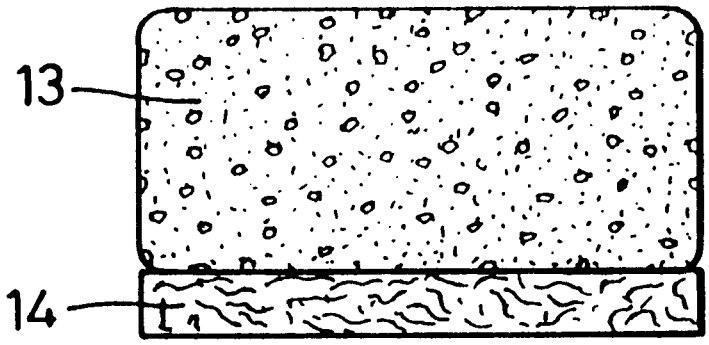
FIGS. 5(A) and 5(B) are cross-sectional views of other forms of applicator means for use with the apparatus shown in the other Figures.
Figure 5B:
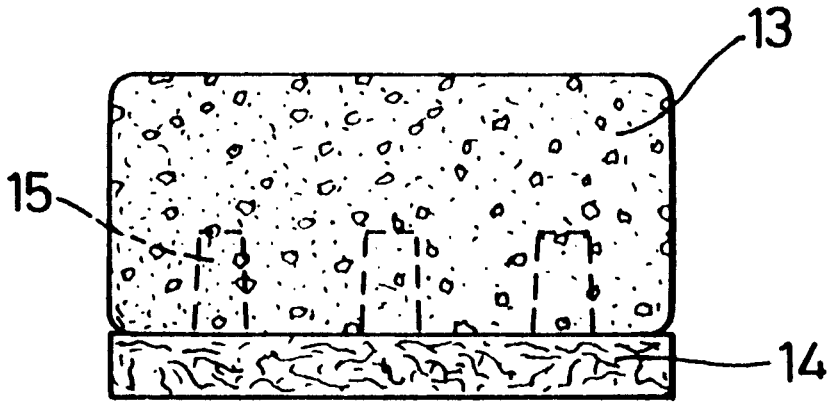

FIGS. 5(A) and 5(B) illustrate other types of applicator means. These comprise a block of sponge 13 with a layer of more abrasive material 14 attached to one face thereof in the manner of conventional scouring pads, eg as manufactured by 3M and sold under the trade name Scotchbrite.

The abrasive material 14 can be used to abrade the surface of a solid block of material 9 such as that described above so as to remove particulate material therefrom. This may then be applied to a surface as a guide coat using either the sponge 13 or, in some cases, by the abrasive layer 14.

FIG. 5(B) shows a similar applicator which is provided with reservoirs 15 formed within the interior thereof. Powder generated by rubbing the abrasive layer 14 on the block 9 is absorbed into the reservoirs whereupon it can pass more easily to the opposite side of the applicator means to be applied to a surface by the sponge 13.

Applicators such as those described in relation to FIGS. 5(A) and 5(B) may also be used with any of the other embodiments described above. The powder may be sprinkled onto the applicator or the applicator may be dipped into the powder so as to become impregnated therewith. Either the abrasive material 14 or the sponge 13 may be used to apply the powdered guide coat. The abrasive material 14 may, if desired, also be used for abrading the surface to which the guide coat is to be applied.

Figure 6:
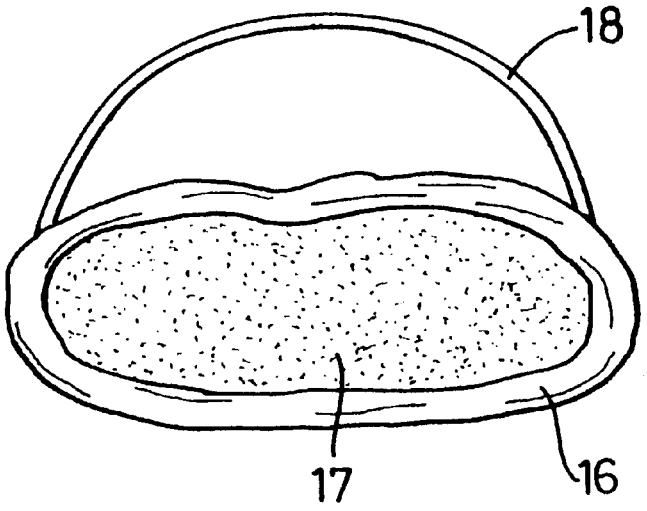
FIG. 6 is a cross-sectional view of a fifth embodiment of apparatus according to the invention.

FIG. 6 is a cross-sectional view of a further embodiment of apparatus for applying a guide coat. This comprises applicator means 16, such as an absorbent cloth, formed into an enclosure and a reservoir of powdered material 17 within the enclosure. The powdered material impregnates the absorbent cloth 16 and thus permeates through the walls of the enclosure. The powdered material 16 thus migrates to the outer surface of the applicator means whereupon the applicator means may be wiped over a surface to form a guide coat thereon.

FIG. 6 also shows an optional strap 18 of the type described in relation to FIG. 4 for facilitating the holding of the applicator means in the hand.

Figure 7:
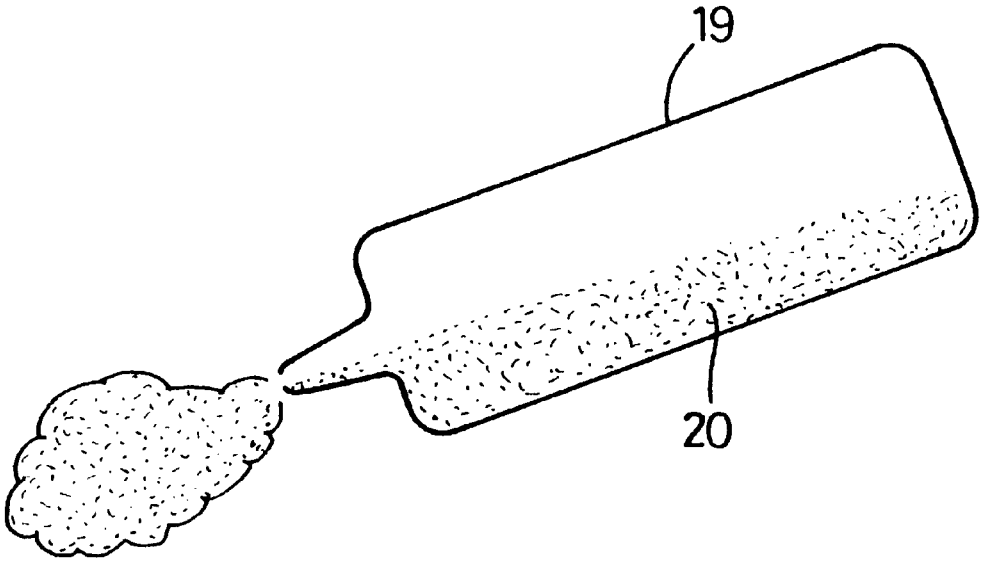
FIG. 7 is a cross-sectional view of a sixth embodiment of apparatus according to the invention.

FIG. 7 shows yet another form of applicator for applying a powder to a surface as a guide coat. This comprises a compressible container 19, eg a plastics bottle, with a nozzle. Powdered material 20 held within the container can be puffed out through the nozzle as an air-borne cloud of powder by simply squeezing the container. A guide coat can thus be formed on a surface by directing such puffs of powder onto the surface.

It will be appreciated that the apparatus described above, although of simple construction, provide an easy and effective way of applying a guide coat to a surface. The method of forming a guide coat described also has many advantages over conventional methods: masking of surrounding paint work is not required, it uses more environmentally safe materials which are not combustible or volatile, no special storage conditions are required and the powder has a long shelf-life, and, if a dry powder is used, no drying time is required once the guide coat has been applied.

INDUSTRIAL APPLICABILITY

The apparatus and method described can be used in a wide variety of applications such as the rubbing down of layers of filler or primer or undercoats of paint used in the repair of a car body panel as described above including both dry flatting processes and wet and dry processes. It may also be used for forming a guide coat in the rubbing down or machining of other surfaces whether of metal, wood, glass or other material.

What is claimed is:

1. A method of forming a guide coat on a surface of a vehicle to highlight irregularities in the smoothness of the vehicle surface as part of a smoothing or refinishing operation, the method comprising the steps of:

providing an applicator;

applying a finely divided, particulate material onto the applicator;

contacting the applicator to the vehicle surface to distribute the finely divided, particulate material over the vehicle surface such that the particulate material remains on, and highlights, irregularities in the smoothness of the vehicle surface to form a guide coat for highlighting the irregularities as part of the smoothing or refinishing operation.

2. A method as claimed in claim 1 in which the particulate material is distributed over the surface by wiping the applicator which is impregnated with the particulate material over the surface.

3. A method as claimed in claim 1 in which the particulate material comprises powder paint.

4. The method of claim 1, including applying the finely divided, particulate material onto the applicator from a container within which the material is held.

5. The method of claim 4, including fitting the applicator within the container before and after use.

6. The method of claim 5, including closing the container by fitting the applicator within an open end of the container.

7. The method of claim 4, including attaching the applicator to closure means to close the container.

8. The method of claim 7, including holding the closure means by a holding means, thus assisting an operator to hold the applicator by hand.

9. The method of claim 4, including sprinkling or shaking the particulate material through perforated means provided in the container.

10. The method of claim 9, including mixing a drying agent with the particulate material, the drying agent being dimensioned such that when the particulate material is shaken through the perforations, the passage of the drying agent therethrough is prevented.

11. The method of claim 1, including using the applicator to release the particulate material as a gas-borne cloud of material.

12. The method of claim 1, wherein the applicator comprises a synthetic foam material.

13. The method of claim 12, including providing a surface of the applicator with abrasive material.

14. The method of claim 1, wherein the particulate material is a powder paint.

15. The method of claim 9, including sealing the perforated means before and after use to prevent material passing through the perforations.

16. The method of claim 1, including wiping or blowing the particulate material off a substantially smooth surface of the vehicle but not from substantially rough surfaces.

17. The method of claim 1, including forming a surface of roughness by rubbing down the surface with abrasive sheet such that the particulate material remains on the surface of roughness.

18. The method of claim 1, including removing the particulate material from the surface by rubbing down with one or more abrasive materials selected from the group consisting of abrasive blocks, wet sand paper and dry sand paper.

19. The method of claim 1, wherein the particulate material is non-staining to paint finishes.

20. The method of claim 1, wherein the particulate material is black.

21. The method of claim 20, wherein the particulate material includes carbon black.

22. A method of smoothing or refinishing a vehicle surface comprising the steps of (a) forming a guide coat of finely divided particulate material on the vehicle surface to visually enhance irregularities in the smoothness of the surface and (b) at least one of abrading, filling and reworking the vehicle surface irregularities thus highlighted.

* * * * *

UNITED STATES PATENT AND TRADEMARK OFFICE

CERTIFICATE OF CORRECTION

PATENT NO. : 6,068,880
DATED : May 30, 2000
INVENTOR(S) : Robin William Hills

It is certified that error appears in the above-identified patent and that said Letters Patent is hereby corrected as shown below:

Title page,
Item [56], References Cited, U.S. PATENT DOCUMENTS, insert
-- 4,393,112 7/1983 Honjo et al. 428/207 --.

Signed and Sealed this

Eleventh Day of March, 2003

JAMES E. ROGAN
*Director of the United States Patent and Trademark Office*